United States Patent [19]

Pocanschi

[11] Patent Number: 4,707,871

[45] Date of Patent: Nov. 24, 1987

[54] FOLDING BED-TABLE MEANS

[76] Inventor: Adrian Pocanschi, Hauptmannsreute 94, 7000 Stuttgart 1, Fed. Rep. of Germany

[21] Appl. No.: 873,554

[22] Filed: Jun. 12, 1986

[51] Int. Cl.[4] ..... A47C 19/00

[52] U.S. Cl. ..... 5/3; 5/4; 5/151

[58] Field of Search ..... 5/3–7, 5/151–153, 162

[56] References Cited

U.S. PATENT DOCUMENTS 807,909 12/1905 Braznell ..... 5/152
913,032 2/1909 McGaw ..... 5/4
1,160,442 11/1915 Palmer ..... 5/4

FOREIGN PATENT DOCUMENTS 818096 10/1951 Fed. Rep. of Germany ..... 5/6
328860 5/1930 United Kingdom ..... 5/4

*Primary Examiner*—Gary L. Smith
*Assistant Examiner*—Michael F. Trettel
*Attorney, Agent, or Firm*—William A. Drucker

[57] ABSTRACT

A folding bed-table wherein the bed is convertible into a table, single or double desk, lounge or the like which includes a base frame having a pair of coextensive side members, extension members pivotally connected at one end to the free ends of the side members, the other end of the extension members being interconnected by a plate, a table hinged to the plate and a prop between the plate and extension member pivoted to one of them.

2 Claims, 8 Drawing Figures

FOLDING BED-TABLE MEANS

BACKGROUND OF THE INVENTION

The present invention relates to a folding bed-table means, in which a sleeping or resting means with folding table plates is provided.

A double use as a bed and table is already known in that on a bed frame is placed a table plate, which is conventionally placed against the wall and on same is engaged the frame. However, this suffers from the disadvantage that, due to the bed, whose dimensions remain unchanged, it is not possible to sit correctly round the table. In addition, this known means is difficult to transport and cannot serve as two separate pieces of furnture.

SUMMARY OF THE INVENTION

The problem of the present invention is to provide a folding bed-table means, which can simultaneously fulfill the function of a bed and a table in a compact arrangement by simple rotary movements.

A further object of the invention is that the means can be broken down into three parts and can be easily assembled.

Another object of the invention is to ensure that the bed is not recognized as such when in the table state and conversely that the table does not have bed-like traits, so that the means has in all cases the character of a unitary item of furniture.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENT

Figure 1:
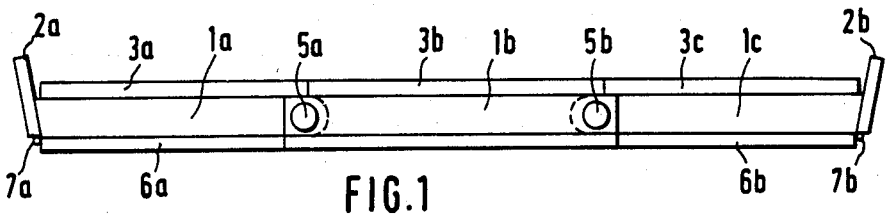
FIG. 1, a side view of the first embodiment in the bed state.

FIG. 1 is a side view of the embodiment with three lateral parts of the bed body 1*a*, 1*b*, 1*c*, which are interconnected by means of joints 5*a*, 5*b*. At the ends of parts 1*a* and 1*c* to the left and right are provided bed front plates 2*a*, 2*b*, which are connected by hinges 7*a*, 7*b* to the table plates 6*a*, 6*b*. Wood bolts 5*a*, 5*b* are visible in the joints.

Figure 2:
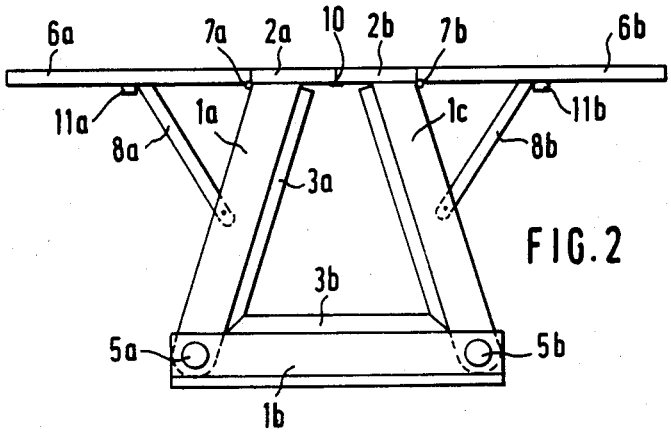
FIG. 2, a side view of the embodiment according to FIG. 1 in the table state.

FIG. 2 shows the embodiment according to FIG. 1 in the table state, the same references designating the same parts. Only the shear supports or brackets 8*a*, 8*b* have been added, because they have been folded down. Thus, in the bed state, they engage in the free space between the bed grid 4, pl of FIG. 3 and the lower edge of the side parts of the bed body 1*a*, 1*c*.

FIG. 2 also shows the clamping fitting 10, which ensures the connection between the bed front plates 2*a*, 2*b* in the table state. It is also possible to see the precision of mattresses 3*a*, 3*b*, which can in the represented manner be housed in the frame of bed body 1*a*, 1*b*, 1*c*.

FIG. 2 is a front view, partly in section through the central region in the bed state according to FIG. 1. As can be gathered, the side parts of the bed body 1*a*, 1*b*, 1*c* are held together by wood bolts 5*a*, 5*c*. This permits in a simple manner an articulated connection between the three parts of the bed frame. The headed wood bolts 5*a*, 5*c* can easily be fitted and removed. As soon as the wood bolts have been removed, the means is broken down into three components, which can be brought into a compact form, e.g. for shipping. This compact form results from the fact that the components, which approximately have the same dimensions are placed on one another.

Figure 3:
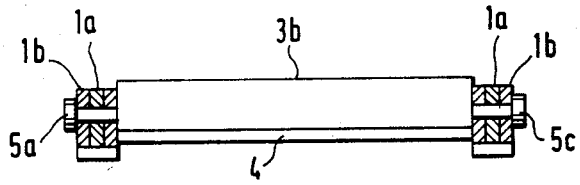
FIG. 3, a front view, partly in section of the embodiment of FIG. 1.

FIG. 3 shows that the means is constructed symmetrically, because there are identical parts to the right and left, which are held together at the bottom by bed grids 4, on which rest mattresses 3*a*, 3*b*. FIG. 3 only shows a single bed grid 4, but several of these are provided, as can be gathered from FIG. 4 and are firmlly connected to side parts 1.

Figure 4:
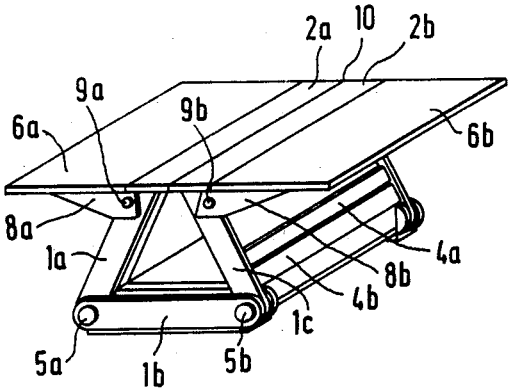
FIG. 4, a perspective view of another embodiment in the table state.
Figure 5:
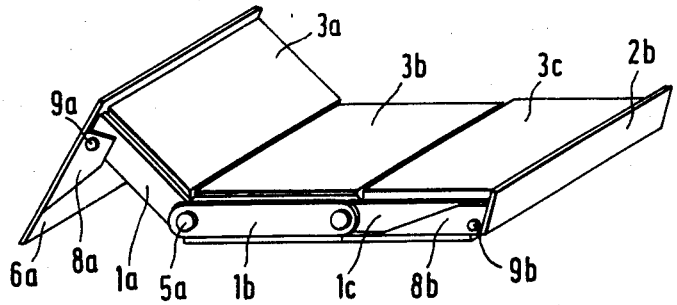
FIG. 5, a view of the embodiment according to FIG. 4 in the form of a couchette or lounger.
Figure 6:
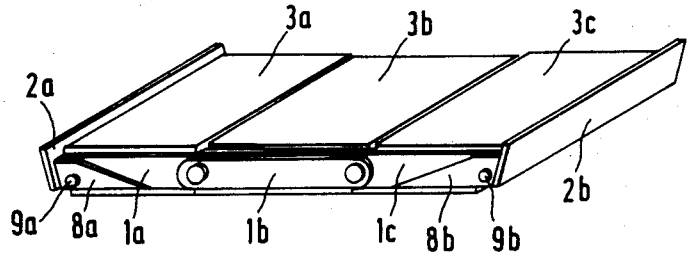
FIG. 6, a perspective view of the embodiment according to FIGS. 4 and 5 in the bed state.

FIG. 4 shows a somewhat modified embodiment, in which the shear supports 8*a*, 8*b* are somewhat differently constructed, as can be gathered from FIGS. 5 and 6. They are namely fixed in an articulated manner to the corresponding side parts of the bed frame 1*a*, 1*c* by means of wood screws 9*a*, 9*b*. FIG. 4 also shows certain of the bed grids 4*a*, 4*b*. As the construction is symmetrical, there are further grids on the other side.

FIG. 5 shows the embodiment according to FIG. 4, but in this case in the form of a couchette or lounger. For this purpose the side parts 1*a* have been so arranged at an angle about the joint with the wood bolts 5*a*, that the mattress 3*a* forms a head support. For this purpose, the table plate 6*a* has also been arranged at an angle to the side part 1*a* in the represented manner for supporting the head piece, which ensures an absolutely reliable supporting thereof.

FIG. 6 again shows the bed means according to FIG. 1.

Hereafter, the conversion of the bed means according to FIGS. 1 and 5 into the table means according to FIGS. 2 and 4, as well as the lounger according to FIG. 5 will be explained. In order to pass from the bed means according to FIGS. 1 and 5 to the table means, side parts 1*a*, 1*c* have been pivoted upwards by more than 90° about the joints with bolts 5*a*, 5*b*, so that they assume the positions according to FIGS. 2 and 4. Then, the table plates 6*a*, 6*b*, which where previously located below the means, are placed on the means and interconnected by the clamping fitting 10, the shear supports 8*a*, 8*b* also being swung out in the represented manner. In the case of FIG. 2, there are stops 11*a*, 11*b* on the underside of table plates 6*a*, 6*b*, so that the supports 8*a*, 8*b* have a hold. According to the embodiment of FIG. 4 this is not necessary, because the screws 9*a*, 9*b* can arrest supports 8*a*, 8*b*. Mattresses 3*a*, 3*b*, 3*c* can remain in their previous position, as shown in FIG. 2.

A description has already been given as to how it is possible to pass from the bed arrangement into the lounger arrangement according to FIG. 5.

There is an additional possibility of varying the table according to FIGS. 2 or 4. For this purpose, at one of the two table plates 6*a* or 6*b* can be flapped downwards at an angle and arrested there, support 8*a* or 8*b* engaging on the outer edge of the corresponding plate 6*a*, 6*b* according to FIG. 2. According to FIG. 4, no additional stop corresponding to stops 11*a*, 11*b* need be provided, because through a corresponding tightening of bolts 9*a*, 9*b*, it is possible to fix said position. This is not shown in the drawing, but is readily comprehensible to the Expert.

Figure 7:
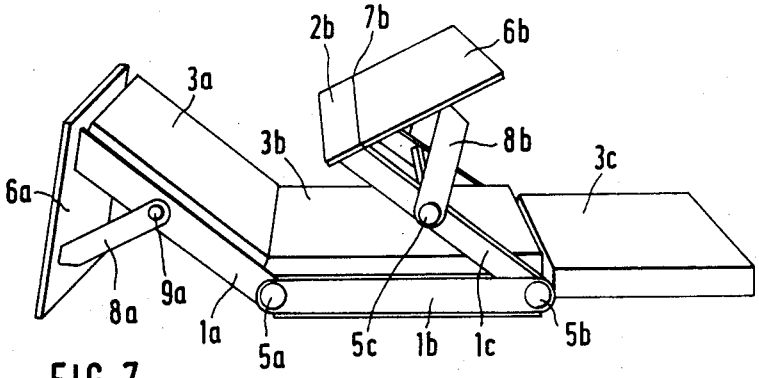
FIG. 7, another embodiment in the couchette or lounger state with a drawing table.

The following possibility also exists. FIG. 7 shows a somewhat modified embodiment in another position, namely that of a lounger or couchette according to FIG. 5, but here provided with a drawing table. It is also possible to arrive at such an embodiment from the lounger according to FIG. 5. Thus, side parts 1*c* and the corresponding parts on the opposite side of mattress 3*c* are pivoted upwards at an acute angle. Mattress 3 stays in position. Wood bolt 5*b* and the corresponding bolt on the other side are tightened. The other table plate 6*b* can now be fixed to side parts 1*c* in such a way that a drawing table if formed from the two parts 2*b* and 6*b* according to FIG. 7. This leads to the special feature that in the half-laying position on the lounger, it is possible to use the drawing table according to FIG. 7. Stops 11*b*, as in FIG. 2, are not absolutely necessary. It is sufficient for there to be grooves or recesses in the bottom of table 6*b* into which can be engaged the shear supports 8*b*, the same applying with respect to shear supports 8*a*.

Figure 8:
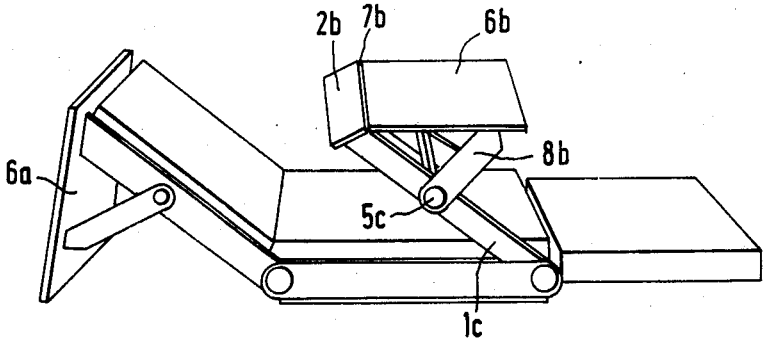
FIG. 8, the same as in FIG. 7, but with a dining table over the couchette or lounger.

FIG. 8 shows the embodiment according to FIG. 7, but with a dining table. For this purpose, table plate 6*b* is not placed at an angle to the horizontal as in FIG. 7 and is instead positioned roughly parallel to mattresses 3*b*, 3*c*. The bed front plate 2*b* facing the resting person can remain at an angle to the horizontal as in FIG. 7. Thus, table plate 6*b* here acts as a dining table plate, e.g. for an unwell person. Once again there is no need for stops 11*a*, 11*b*, if on the corresponding point of the undersurface of table plate 6*b* recesses are provided for the shear supports in a further position.

What is claimed is:

1. A folding bed-table means in which a sleeping means can be convverted into a table, a table with desk or a double desk, into a lounge, a lounge with table or a lounge with desk with the following parts:

(a) a base frame comprising a pair of elongated spaced parallel coextensive side members each having opposed free ends, (b) extension members having opposed ends pivotally connected at one end to the free ends of each side member, the other ends of the extension members being interconnected by a rigid plate element, (c) a table plate hinged to an outer end of each plate element, and (d) a prop member extending between the table plate and extension member and pivoted to one of them to maintain the table plate in laterally extended position relative to the side member.

2. A folding bed-table according to claim 1 including bed slats extending between the side members for supporting a mattress thereon.

* * * * *